United States Patent [19]

Vanchot

[11] 4,262,753

[45] Apr. 21, 1981

[54] PLOW BLADE ATTACHMENT SYSTEM

[76] Inventor: André H. Vanchot, 65 Marshall La., Derby, Conn. 06418

[21] Appl. No.: 33,853

[22] Filed: Apr. 27, 1979

Related U.S. Application Data

[62] Division of Ser. No. 850,688, Nov. 11, 1977, Pat. No. 4,164,821.

[51] Int. Cl.[3] ..... E02F 3/76

[52] U.S. Cl. ..... 37/41; 37/141 R; 172/701.3

[58] Field of Search ..... 172/753, 749, 750, 751, 172/719, 767; 37/141 R

[56] References Cited

U.S. PATENT DOCUMENTS

| | | | |
|---|---|---|---|
| 885,019 | 4/1908 | Conley | 172/753 |
| 1,206,224 | 11/1916 | Johnston | 172/751 |
| 1,358,584 | 11/1920 | Schenk | 172/753 |
| 2,254,011 | 8/1941 | Kernodle | 172/751 |
| 3,202,226 | 8/1965 | Carson | 172/753 |
| 3,477,520 | 11/1969 | Gray | 172/753 |
| 4,058,173 | 11/1977 | Carson | 172/753 |
| 4,164,821 | 8/1979 | Vanchot | 172/751 |

FOREIGN PATENT DOCUMENTS

| | | | |
|---|---|---|---|
| 203012 | 6/1965 | Sweden | 172/719 |

*Primary Examiner*—Richard J. Johnson

*Attorney, Agent, or Firm*—Mattern, Ware, Davis & Stoltz

[57] ABSTRACT

By providing a plow and scraper blade assembly with a camming and securing member at one end and a pivotable, blade locking member at the other end, along with a cooperating, interfittingly engageable plow blade, a plow and scraper blade assembly is achieved wherein the plow blade is easily and quickly installable and removeable. In the preferred embodiment, a blade nesting and engaging channel is incorporated along with a plurality of stiffening ribs spaced along the channel to provide rigidity to the plow blade while enhancing the blade's rapid installation and removal qualities.

9 Claims, 4 Drawing Figures

FIG. 1
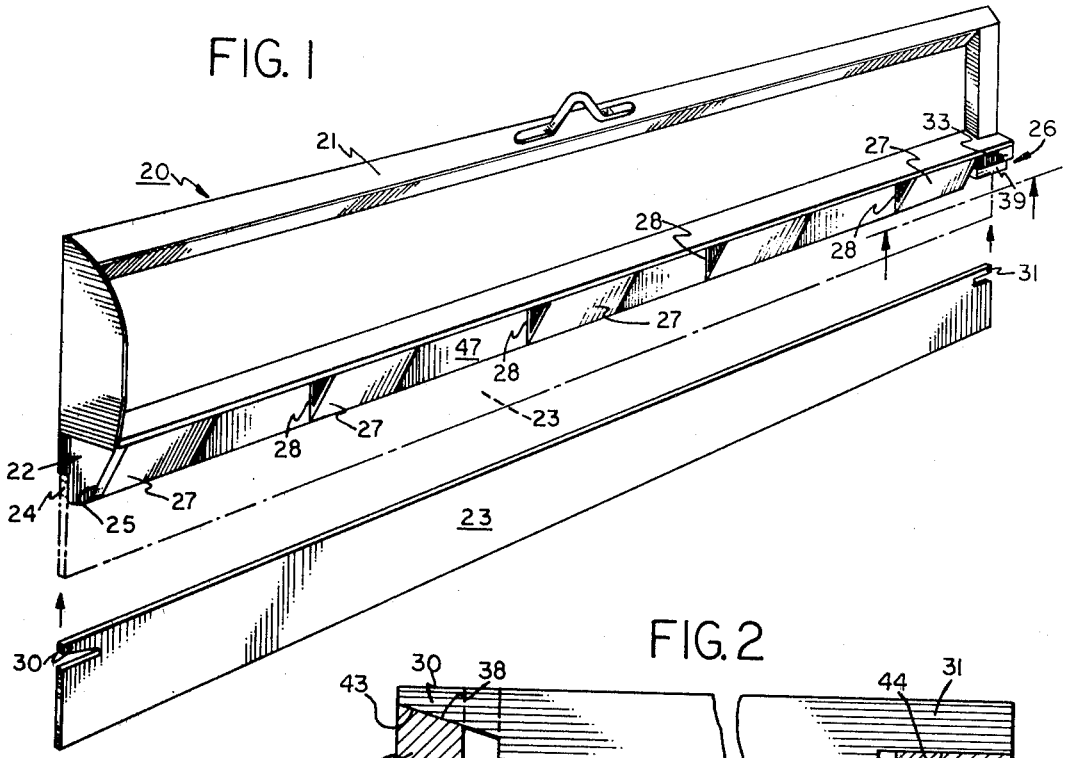
FIG. 2
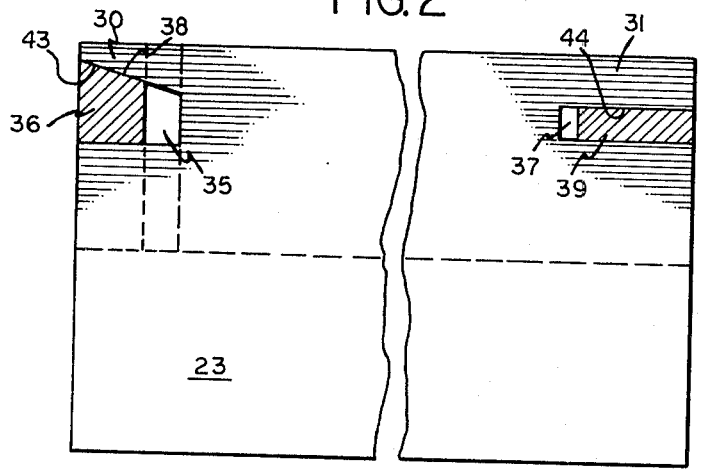
FIG. 4
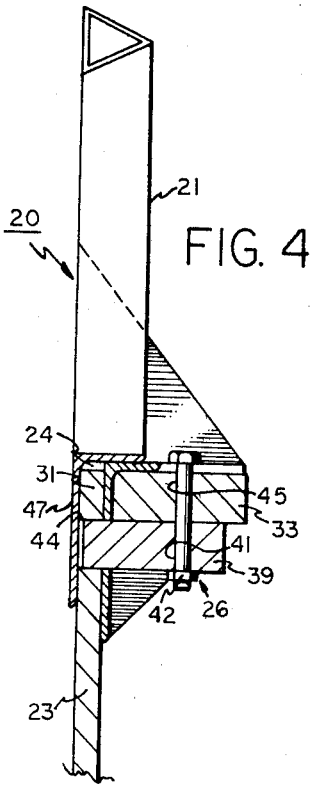
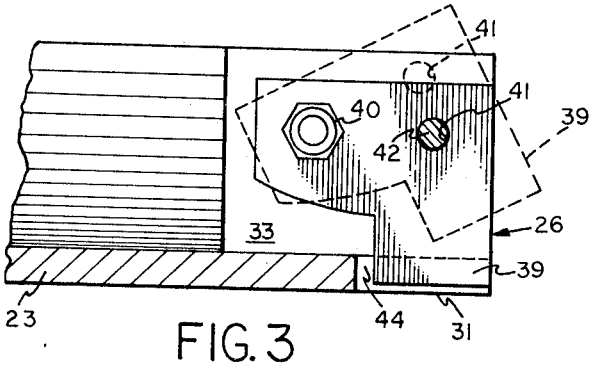
FIG. 3

PLOW BLADE ATTACHMENT SYSTEM

This is a division, of application Ser. No. 850,688 filed Nov. 11, 1977, now U.S. Pat. No. 4,164,821.

BACKGROUND OF THE INVENTION

This invention relates to plow and scraper assemblies and more particularly to plow and scraper assemblies having blades detachably removeable from the mould board.

Generally, when plow and scraper assemblies are used for the removal of snow or ice or for the leveling of road surfaces, the scraper blades are easily damaged or worn down, necessitating repair or replacement. Since it is cumbersome and unrealistic to remove an entire plow or scraper assembly from the vehicle each time the blade must be removed, the plow and scraper assemblies incorporate detachable blades.

These prior art detachable blades are almost universally secured to the plow body or mould board of the plow assembly with a plurality of bolts. However, the use of fastening bolts has been found to be expensive as well as dangerous. The most severe problems exist with plow assemblies used for snow and ice removal, since the bolts become rusted, corroded, and difficult to remove.

Generally, it is necessary to cut, break, or burn the bolts off in order to remove the blade. This necessitates spending a great deal of manual effort. Furthermore, the incidence of injury during the removal of the blades was quite high, since force is typically required to dislodge the bolts, resulting in the shattering and aerial propelling of portions of the bolts.

Although various prior art systems have been developed in an attempt to eliminate the difficulties inherent in the use of bolts, no system has been developed which matches the ease of operation and secure, repeatable locking attachment of the present invention.

The following is a list of prior art references which are believed to be pertinent:

| U.S. Pat. No. | Issue Date | Inventor |
|---|---|---|
| 3,477,520 | 11/11/69 | J. J. Gray |
| 3,202,226 | 8/24/65 | C. W. Carson |
| 3,190,018 | 6/22/65 | M. P. Nelson |
| 3,090,140 | 5/21/63 | V. E. Trana |
| 1,741,933 | 12/31/29 | J. H. Gunnison |
| 1,885,231 | 11/1/32 | L. L. Chong et al |

Gray, U.S. Pat. No. 3,477,520, employs a plurality of horizontal slots in the plow body, coupled with wedge blocks mounted to the plow blade which interfit with the slots in the plow body. This greatly increases the cost of the manufacture of the plow blade and the plow body. Carson, U.S. Pat. No. 3,202,226, uses a complicated system of interlocking trapezoidally shaped wedges mounted on the plow blade which fit into similarly shaped sockets in the plow body. Further reinforcement and securing members are necessary in order to hold the plow blade securely in position. Nelson, et al, U.S. Pat. No. 3,190,018, also teaches the use of lugs mounted on the plow blade that fit through slots in the plow body. Apertures in the lugs are designed to receive a tapered bar which acts to pull the blade in tight abutment with the plow body. This invention also involves much expense in manufacture.

Trana, U.S. Pat. No. 3,090,140, utilizes an aperture cut into the plow body to receive the plow blade. The blade is held in place by frictional means. Gunnison, U.S. Pat. No. 1,741,933, also uses projections mounted on the plow blade to interfit with flanges on the plow body. Cotter keys are used as attachment means in the Gunnison invention. Finally, Chong, U.S. Pat. No. 1,885,231, teaches the use of a slotted screw attachment system for mounting a small blade onto a garden tool structure.

Although these various prior art attempts have been made to provide an inexpensive and reliable blade securement system, these prior art systems have failed, and only produced a variety of expensive, cumbersome constructions which do not overcome the continuing problems of ease of installation and removal, low manufacturing costs, simplicity of operation, and secured engaged attachment of the plow blade to the plow body.

Therefore, it is a principal object of this invention to provide a plow and scraper assembly in which the plow blade is quickly and easily installable and removeable from the plow body or mould board.

Another object of this invention is to provide the plow and scraper assembly having the characteristic features defined above wherein the plow blade remains in secured engagement with the mould board throughout its use when mounted therewith.

Another object of this invention is to provide the plow and scraper assembly having the characteristic features defined above wherein both the plow blade assembly are inexpensively manufactured and capable of operative use with a minimum of effort.

Other and more specific objects will in part be obvious and will in part appear hereinafter.

SUMMARY OF THE INVENTION

The plow body and blade assembly of the present invention overcomes all of the prior art problems by providing a plow blade and mould board construction which completely eliminates the time-consuming and difficult operations required in the prior art systems. In the present invention, the plow blade is easily installable on and removeable from the mould board, as well as securely held in place during its operative use. Further, the plow blades and mould boards are easily and inexpensively manufactured, while existing mould boards are quickly and easily convertible to the system of the present invention.

In the present invention, the mould board of the plow body incorporates an elongated blade support assembly having a plow blade camming and securing portion at one end thereof, a plow blade engaging and locking portion at the other end thereof and an elongated blade receiving and nesting channel. In the preferred embodiment, a plurality of reinforcing, stabilizing members are disposed along the length of the channel to provide stiffening and securing support to the blade when mounted in position. The plow blade preferably is a conventional elongated rectangular shape with a cam cooperating flange and recess at one end and a slot formed in the other end. The cam cooperating flange and recess of the blade is constructed for cooperative pivoting and sliding inter-connection with the camming and securing portion of the blade support assembly.

In operation, the plow blade of the present invention is quickly and easily installed and securely engaged with the blade support assembly of the present invention by first inserting the flange formed at one end of the blade into the camming and securing portion of the blade support assembly. Then, the blade is pivoted and cammingly slid along camming and securing portion until the blade is in abutting contact with the blade receiving and nesting channel of the blade support assembly. The installation is then easily and quickly completed by pivoting the blade engaging and locking member of the blade support assembly into secure, locking engagement with the slot formed at the opposite end of the plow blade. The plow blade is then completely locked in this secure engaged position by inserting a bolt or similar fastening means into the pivoting, blade engaging and locking member.

In order to remove the blade, only the single fastener is removed. This allows the blade engaging and locking member to pivot into its open position, thereby allowing the plow blade to drop down from its normal position and be quickly and easily withdrawn from the camming and securing portion of the blade support assembly. The blade may then be sharpened, repaired or replaced as desired and easily reinstalled in the blade support assembly.

The invention, accordingly, comprises a structure possessing the features and properties which will be exemplified in the structures hereinafter described and the scope of the invention will be indicated in the claims.

THE DRAWINGS

For a fuller understanding of the nature and objects of the present invention, reference should be made to the Detailed Description, taken in connection with the accompanying drawings in which:

FIG. 1 is an exploded perspective view of a plow and scraper assembly constructed according to the teachings of the invention.

FIG. 2 is a cross-sectional front elevational view, partially broken away, of the plow blade of the present invention taken along line 2—2 of FIG. 1.

FIG. 3 is a cross-sectional bottom plan view, partially broken away, of the plow and scraper assembly taken along line 3—3 of FIG. 1.

FIG. 4 is a cross-sectional side elevational view, partially broken away, of the plow and scraper assembly of FIG. 1 taken along line 4—4.

DETAILED DESCRIPTION

In FIG. 1, plow and scraper unit 20 is shown having a mould board 21, a blade support assembly 22, and a plow blade 23. Mould board 21 is adapted for mounting to any type of vehicle and incorporates blade support assembly 22 mounted thereto along the lower edge thereof. Blade 23 is shown removed from blade support assembly 22, with the locked, securely engaged position of blade 23 in support assembly 22 shown in phantom.

Blade support assembly 22 of this invention comprises a blade camming and holding member 25 mounted at one end of mould board 21 and a blade engaging and locking system 26 mounted to the other end of mould board 21. As shown in FIG. 2, blade camming and holding member 25 comprises camming and holding surface 38 for cooperative sliding, camming and holding engagement with blade 23.

In the preferred embodiment, camming and holding surface 38 extends longitudinally downwardly and comprises the upper, slanting surface of a substantially trapazoidally shaped boss 36. Of course, boss 36 may comprise any desired shape, however, the downwardly ramped camming and sliding surface 38 is preferably incorporated into boss 36 as the top surface thereof.

As best seen in FIGS. 3 and 4, blade engaging and locking system 26 incorporates a blade locking and engaging arm 39 and a supporting plate 33. Plate 33 is preferably, permanently mounted to mould board 21 and locking and engaging arm 39 is pivotally secured to plate 33. In the preferred embodiment, bolt 40 interconnects arm 39 with plate 33 while also assuring free pivoting movement of arm 39 about the axis defined by bolt 40. As is fully described below, the free pivoting of arm 39 assures the quick and easy secure locking engagement of blade 23.

In order to assure the secure, locked retention of blade 23 in its engaged position, arm 39 incorporates a locking hole 41 and plate 33 incorporates a similarly dimensioned, axially aligned locking hole 45. When locking holes 41 and 45 are axially aligned, bolt means 42 is inserted therethrough in order to assure secure locked retention of arm 39 in its blade engaged position. As should now be clear from this discussion, the blade locking and engaging system of this invention provides ease of installation and secure, locked engagement of a plow blade using only a single bolt.

In the preferred embodiment, blade support assembly 22 also incorporates a blade receiving channel 24 longitudinally disposed along the lower edge of mould board 21. Channel 24 is formed between a forwardly positioned, elongated blade-containing lip member 47 and a plurality of stiffening ribs 27, each of which comprises a blade engaging surface 28. As best seen in FIG. 4, channel 24 contains blade 23 between lip member 47 and ribs 27 in order to eliminate or substantially reduce the front-to-back movement of blade 23 during use. Furthermore, ribs 27 impart additional stiffening to blade 23 along its entire length.

As best seen in FIGS. 1 and 2, plow blade 23 of this invention is shown as comprising an elongated, substantially rectangular structure incorporating, at one end thereof, a camming, sliding and holding surface 43 formed on a flange 30. The other end of the plow blade 23 incorporates a flange 31 which comprises an arm engaging surface 44 and defines a locking arm engaging slot 37.

In the preferred embodiment, camming, sliding, and holding surface 43 comprises the lower edge of flange 30 and is downwardly slanted from the edge of blade 30 inwardly toward the center of blade 30. Camming and holding surface 43 also defines a recess 35 which is dimensioned for cooperative interconnection with boss 36 of blade support assembly 22. Although any flange and camming and holding surface construction can be employed without departing from the scope of this invention, the downwardly slanted, longitudinally extending surface is preferred in order to assure ease of installation and secure holding retention with manufacturing ease.

Flange 31 formed on the opposite end from flange 30 preferably incorporates arm engaging surface 44 as its lower edge, with surface 44 defining arm engaging slot 37. Arm engaging slot 37 is dimensioned for cooperative, securely engaged positioning of arm 39 in slot 37. Although any shape can be employed, a substantially rectangular recess 37 is preferred, as well as a substantially flat rectangular arm 39. This construction is preferred for manufacturing simplicity.

By referring to FIGS. 1, 3 and 4, the installation assembly and operation of the plow and scraper assembly will now best be understood. Plow mould board 21 is normally attached to a truck or similar vehicle for use in snow removal or road leveling. Since it is quite cumbersome and difficult to remove the entire plow blade assembly from the vehicle, it is advantageous to have an easily and rapidly installable and removeable plow blade.

The plow blade 23 of the present invention provides such easy attachment and removal. Plow blade 23 is mounted by first placing flange 30 into contact with boss 36 so that camming and sliding surface 43 is in sliding engagement with camming and holding surface 38 of boss 36. The opposite end of the blade 23 is free to rest on the ground to facilitate ease in mounting.

The camming and sliding surface 43 of the blade 23 is then slidingly advanced along the camming and holding surface of boss 36, while simultaneously lifting and upwardly pivoting the free end of the blade 23. This sliding and pivoting movement is continued until flange 30 is securely engaged with boss 36 and blade 23 is nested within the blade receiving channel 24. As discussed above, the shape of boss 36 and slot 35 are alterable, however, boss 36 and slot 35 should be constructed for cooperative interconnection and secured camming engagement and holding of blade 23 about boss 36 with the upper portion of blade 23 firmly positioned within the blade receiving channel 24.

The secure locking engagement of blade 23 in blade support support system 22 is completed by pivoting blade locking and engaging arm 39 about the pivot axis of bolt 40 into locking engagement within the locking recess 37 and abutting contact with surface 44 of flange 31 of blade 23. Bolt 42 is then inserted through aligned holes 41 and 45, and fastened in place. In this way, blade locking and engaging arm 39 is secured in position, assuring that blade 23 is firmly and securely engaged in position within the blade receiving channel 24.

During operation, the support members 27 of the blade support assembly 22 provide added support to blade 23, imparting a stiffening effect to blade 23. This provides added assurance that the blade's structural integrity is maintained and that the blade provides trouble-free operation.

When the blade 23 becomes dull or damaged, the bolt means 42 are easily removed, allowing the pivotable, blade locking and engaging arm 39 to be moved out of engagement with the recess 37 and flange 31 of the blade 23. Then, flange 30 of blade 23 is quickly withdrawn from engagement with the boss 36, by merely reversing the camming and sliding insertion discussed above, and complete removal of blade 23 from blade support assembly 22 is achieved.

From the teaching of this disclosure, it is clear that the uncomplicated construction of blade 23 and the unique construction and arrangement of blade support assembly 22 which combine to form blade and scraper unit 20 of this invention attains heretofore unreachable goals. In particular, the present invention assures ease of manufacture, assembly, installation, and maintenance, thereby keeping costs at a minimum while providing a greatly improved product.

It will thus be seen that the objects set forth above, among those made apparent from the preceding description, are efficiently attained and, since certain changes may be made in the above product without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is:

1. A snow plow blade for rapid installation in a snow plow and scraper unit comprising:

(A) a generally elongated rectangular shape incorporating
  (a) a horizontally extending, elongated top edge,
  (b) two vertically extending side edges in juxtaposed, spaced, parallel relationship, and
  (c) a horizontally extending, elongated bottom edge, in juxtaposed, spaced, parallel relationship to the top edge and incorporating the plowing and scraping portion;

(B) a first flange member
  (a) formed along the upper edge of the blade at one end thereof, and
  (b) incorporating a ramped, camming and sliding surface forming the lower edge thereof; and (C) a first holding recess
  (a) formed in one vertical side edge of the snow plow blade and extending inwardly from said side edge to define therewith a first side edge entrance portal, and
  (b) incorporating the ramped camming surface of the first flange member as the upper surface of the first holding recess;

(D) a second flange member
  (a) formed along the top edge of the blade at the opposite end thereof, and
  (b) incorporating an elongated lock engaging surface as its lower defining edge; and (E) a second holding recess
  (a) formed in the other vertical side edge of the snow plow blade and extending inwardly from said side edge to define therewith a second side edge entrance portal, and
  (b) incorporating the elongated lock engaging surface of the second flange member as the upper surface of the second holding recess.

2. A snow plow blade adapted for rapid installation and removal in a snow plow and scraper unit, comprising:

(A) a single, elongated, substantially rectangular, planar sheet of metal;

(B) a plowing and scraping edge
  (a) forming the lower surface of the elongated, rectangular plow blade, and
  (b) extending longitudinally substantially the entire length of the plow blade; and (C) two plow blade supporting flanges
  (a) formed in the opposed side edges of said planar sheet of metal by flange defining recesses
  (b) spaced apart substantially the entire length of the plow blade,
  (c) positioned in close juxtaposed spaced relationship to the top of said elongated sheet,
  (d) extending from the opposed edges of said sheet towards each other, and (e) engageable with cooperatively associated holding and securing means formed in the plow and scraper unit, whereby said flange defining recesses comprise the only void zones formed in the entire elongated, rectangular sheet of metal forming the snow plow blade and the entire elongated snow plow blade is quickly and easily installed in the snow plow and scraper unit and securely supportingly retained therein by mounting the snow plow blade at only its opposed ends, the secure retention thereof being achieved by the flanges formed at the opposed ends of the plow blade, thereby providing a snow plow blade capable of rapid installation as well as rapid removal, completely eliminating the requirement for bolt securing means.

3. The snow plow blade defined in claim 2, wherein one of said supporting flanges comprises (d) a ramped, inclined, camming and sliding surface formed thereon and extending to the vertical edge of the plow blade, for cooperative interengagement with said snow plow and scraper unit, thereby providing rapid sliding incline insertion and engagement of said snow plow blade flange end with said scraper unit with ease and speed.

4. The snow plow blade defined in claim 2, wherein said ramped incline surface comprises the lower edge of said flange member.

5. The snow plow blade defined in claim 4, wherein the other supporting flange comprises a lower edge defining surface (1) extending to the vertical edge of the plow blade, forming therewith an entrance portal, and (2) extending substantially horizontally, in substantially parallel alignment with the top edge of the snow plow blade, whereby snow plow locking means formed in the snow plow and scraper unit is quickly and easily inserted into locked, holding engagement with the snow plow blade.

6. The snow plow blade defined in claim 2, wherein said flange members are further defined as extending from the top edge of the elongated, rectangular snow plow blade with a longitudinal axis substantially parallel to the central longitudinal axis of the elongated, rectangular snow plow blade.

7. A snow plow blade for rapid installation in a snow plow and scraper unit comprising:

(A) a generally elongated rectangular shape incorporating (a) a horizontally extending, elongated top edge, (b) two vertically extending side edges in juxtaposed, spaced, parallel relationship, and (c) a horizontally extending, elongated bottom edge, in juxtaposed, spaced, parallel relationship to the top edge and incorporating the plowing and scraping portion;

(B) a first flange member (a) formed along the upper edge of the blade at one end thereof, and (b) incorporating a ramped, camming and sliding surface forming the lower edge thereof; and (C) a first holding aperture (a) formed in one vertical side edge of the snow plow blade and extending inwardly from said side edge to define therewith a first side edge entrance portal, and (b) incorporating the ramped camming surface of the first flange member as the upper surface of the first holding recess; and (D) a second holding aperture (a) formed in the snow plow blade and inwardly from the opposed vertical side edge and defining with the blade front and rear surface entrance portals, and (b) incorporating an elongated lock engaging surface as the upper surface of the second holding aperture.

8. The snow plow blade defined in claim 7, wherein the elongated lock engaging surface and the second holding aperture are further defined as extending to the side edge of the blade to form therewith a second side edge entrance portal, and the snow plow blade further comprises (E) a second flange member (a) formed along the top edge of the blade, and (b) incorporating the elongated lock engaging surface of the second holding aperture as its lower edge.

9. A snow plow blade for rapid installation in a snow plow and scraper unit, comprising:

(A) a single, elongated, substantially rectangular planar sheet of metal incorporating (a) a horizontally extending, elongated top edge, (b) two vertically extending side edges in juxtaposed, spaced, parallel relationship, and (c) a horizontally extending, elongated bottom edge, in juxtaposed, spaced, parallel relationship to the top edge and incorporating the plowing and scraping portion;

(B) a first flange defining recess (a) formed in one vertical side edge of the snow plow blade in close, juxtaposed spaced relationship to the top edge of the elongated snow plow blade, (b) extending inwardly from said vertical side edge with a longitudinal axis substantially parallel to the central longitudinal axis of the elongated, rectangular snow plow blade, (c) defining with the vertical side edge of the snow plow blade a first side edge entrance portal, and (d) incorporating a ramped, inclined, camming and sliding surface as the upper surface of the first recess, with said upper surface extending to the vertical side edge of the plow blade, and positioned for cooperative interengagement with said snow plow and scraper unit;

(C) a first flange member formed in one of the top corners of the snow plow blade and incorporating (a) the top edge of the plow blade as the top edge of the flange member, (b) the ramped, inclined, camming and sliding surface of the first recess as the lower edge of the first flange member, and (c) a side edge defined by the vertical side edge of the snow plow blade extending between the top edge of the snow plow blade and the first side edge entrance portal;

(D) a second flange defining recess (a) formed in the other vertical side edge of the snow plow blade in close, juxtaposed spaced relationship to the adjacent top edge of the elongated snow plow blade, (b) extending inwardly from said vertical side edge with a longitudinal axis substantially parallel to the central longitudinal axis of the elongated, rectangular snow plow blade, (c) defining with the vertical side edge of the snow plow blade a second side edge entrance portal, and (d) incorporating an elongated locking surface as the upper surface of the second recess, with said upper surface extending to the vertical side edge of the plow blade; and (E) a second flange member formed in the other top corner of the snow plow blade and incorporating (a) the top edge of the plow blade as the top edge of the flange member, (b) the elongated locking surface of the second recess as the lower edge of the second flange member, and (c) a side edge defined by the vertical side edge of the snow plow blade extending between the top edge of the snow plow blade and the second side entrance portal whereby the entire elongated snow plow blade is quickly and easily installed in the snow plow and scraper unit and securely supportingly retained therein by mounting the snow plow blade at only its opposed ends, the secure retention thereof being achieved by the flanges formed at the opposed ends of the plow blade, with the flange defining recesses being the only void areas formed in the entire elongated rectangular sheet of metal comprising the snow plow blade, thereby providing a snow plow blade capable of rapid installation as well as rapid removal, and completely eliminating the requirement for bolt securing means.

* * * * *